United States Patent [19]

Parlier

[11] Patent Number: 4,480,864

[45] Date of Patent: Nov. 6, 1984

[54] DOOR LOCK

[76] Inventor: Roger Parlier, Villa Prélac, 1166 Perroy, Switzerland

[21] Appl. No.: 376,969

[22] Filed: May 11, 1982

[30] Foreign Application Priority Data

May 15, 1981 [CH] Switzerland ..... 3192/81

[51] Int. Cl.[3] ..... E05C 13/00

[52] U.S. Cl. ..... 292/341.18

[58] Field of Search ..... 292/341.18, 341.19, 292/340

[56] References Cited

U.S. PATENT DOCUMENTS

| | | | |
|---|---|---|---|
| 1,390,519 | 9/1921 | Evans | 292/341.18 |
| 2,969,999 | 1/1961 | Herman | 292/341.18 X |
| 3,606,430 | 9/1971 | Parmel, Jr. | 292/341.18 |

FOREIGN PATENT DOCUMENTS

| | | | |
|---|---|---|---|
| 599209 | 1/1926 | France | 292/341.18 |
| 2225994 | 10/1974 | France . | |

*Primary Examiner*—Richard E. Moore

*Attorney, Agent, or Firm*—Ostrolenk, Faber, Gerb & Soffen

[57] ABSTRACT

A keeper for a bolt having a catch (4) and a housing (27, 28) which presents two internal faces provided with grooves (29). These grooves (29) form an angle with the direction according to which the bolt of the lock moves. A runner (30) carries on two opposite sides forms (31) corresponding to the grooves (29) and sliding in the latter. This runner (30) presents an opening (33) intended to give way to the bolt, one edge (34) of which forms a supporting side for this bolt. Two adjusting screws (32) allow adjustment of the position of the runner (30) with respect to the housing (27, 28) while 4 screws (36) connecting plaques (34, 35) leaning on the housing (27,28) allowing the blocking of the runner (30) with respect to this housing.

10 Claims, 6 Drawing Figures

A
A
D
D
F
1
2
3
4
14
15
16
17
19
20
21
22
23
25
26
27
28
29
30
32
33
34
35
36
37
38

DOOR LOCK

The object of the present invention is a door lock whose main object is to allow adjustment of the height of the supporting surface of the catch for the bolt. Thus can be used the same catch for doors of different thicknesses without having to use a prop.

Such a lock exists and is described in the Swiss Pat. No. 2 493 725 which comprises a catch whose bolt supporting component is adjustable by discrete increments. This is however not entirely satisfactory as it should be possible to adjust the position of this support in a continuous fashion in order to ensure perfect adjustment of the lock.

For this the door lock of the present invention comprises a catch whose housing is intended to be fixed to the frame of the door and which is remarkable by the fact that said housing of the catch comprises, on two internal sides facing each other, parallel grooves forming an angle with the moving direction of the bolt; by the fact that a runner presenting an opening through which the bolt may pass and a support of the latter, comprises forms corresponding to said grooves and slot into the latter; by the fact that adjusting means allow the movement of the runner with respect to the housing and by the fact that a blocking device enables the runner to be fixed on the housing in the desired position.

The attached drawing illustrates schematically and by way of an example a production form of the door lock according to the invention.

Figure 1:
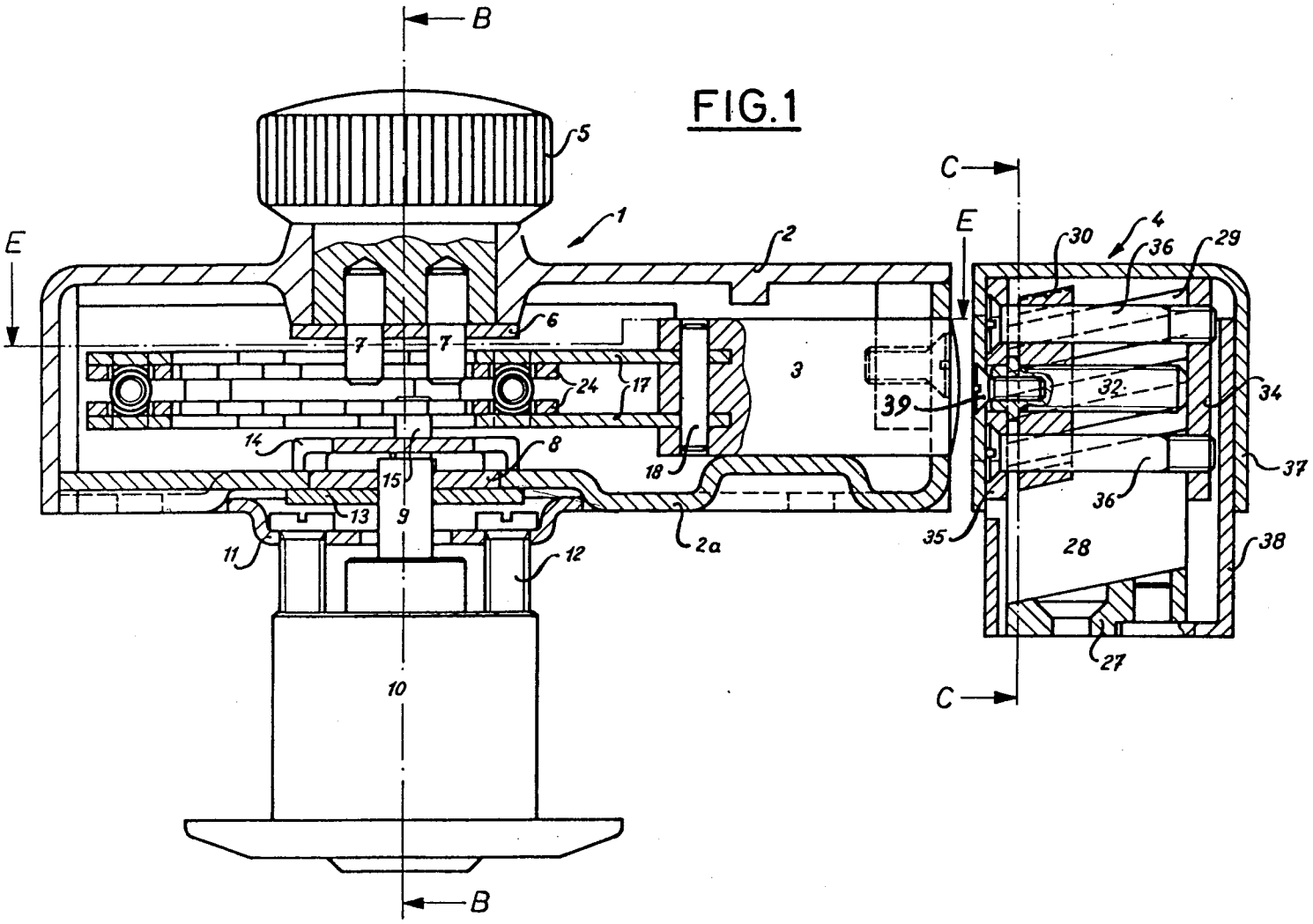
FIG. 1 is a cross-section, following line A—A of FIG. 2, of the door lock.
Figures 2, 3:
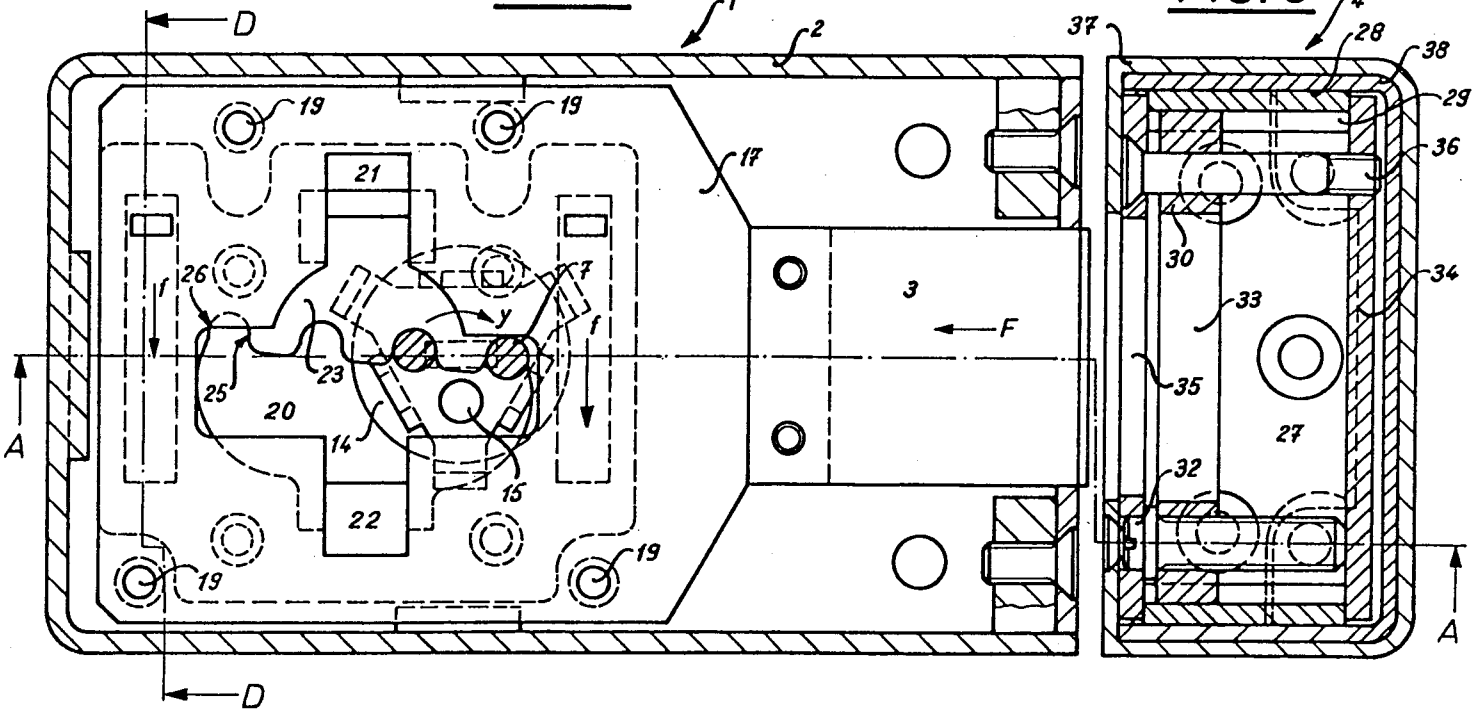
FIG. 2 is a cross-section, following line E—E of a part of the lock illustrated on FIG. 1.
FIG. 3 is a cross-section, following line F—F of FIG. 5.
Figure 6:
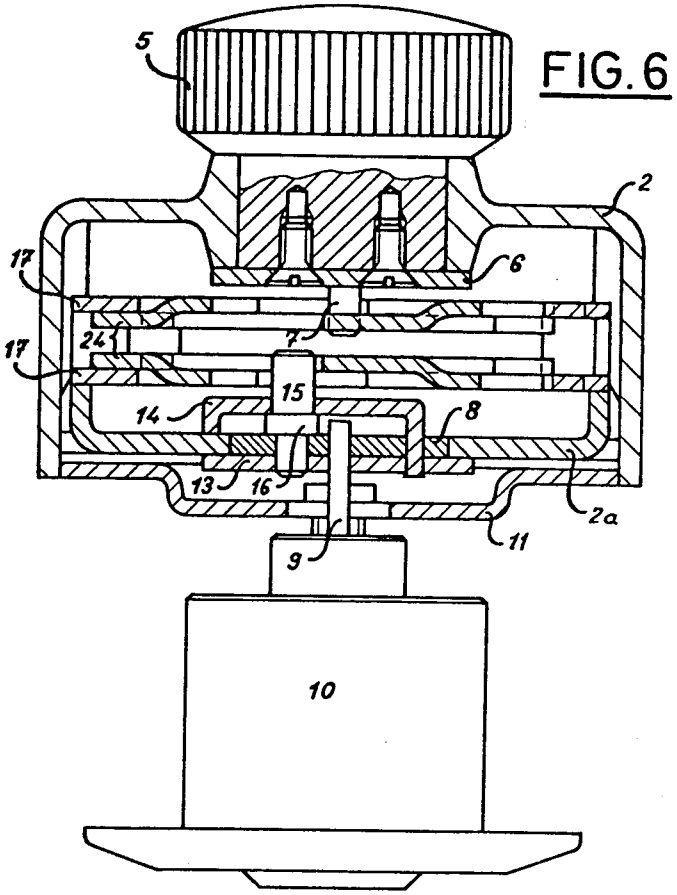
FIG. 6 is a cross-section following line B—B of FIG. 1.
Figure 4:
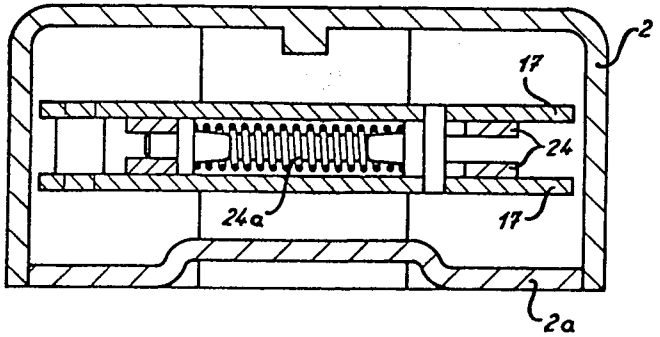
FIG. 4 is a cross-section, following line D—D of FIG. 2.
Figure 5:
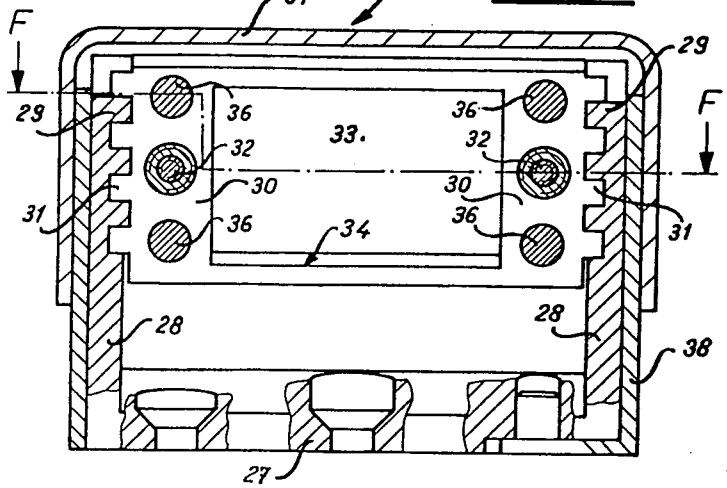
FIG. 5 is a cross-section following line C—C of FIG. 1.

The lock illustrated comprises one part 1 containing a housing 2,2*a*, the bolt 3 and its operating mechanism, as well as a catch 4.

A control button 5 is mounted rotatively on housing 2, held axially by an interior plaque 6 fixed to button 5 by screws. This button 5 comprises two pins 7, diametrically opposite each other with respect to its rotary axis, extending beyond plaque 6 inside housing 2,2*a*.

With respect to button 5, the base plaque 2*a* comprises an opening in which a ring 8 is pivoted. This ring comprises a rectangular central opening giving way to a tongue 9 solid with the revolving part of a locking cylinder 10 fixed on a plaque 11, by screws 12.

The ring 8 is held in position by a plaque 13 riveted to a cover 14 situated on both sides of the ring 8 and the base plaque 2*a*.

A pin 15 is fitted in an offset hole of the ring 8 and stretches beyond cover 14 towards the inside of the housing. This pin comprises a flange 16 held between the cover 14 and the ring 8.

The bolt 3 is assembled by two parallel supporting plaques 17 by pins 18. Plaques 17 are fixed to each other by rods 19. These plaques 17 are mounted by sliding inside housing 2,2*a*.

The supporting plaques 17 comprise a central opening 20 presenting lateral extensions 21, 22 together forming a guide for a transversely mobile stirrup 23 with respect to said plaque 17.

The mobile stirrup is formed by two plaques 24, situated between plaques 17 and fixed parallel to each other.

Springs 24*a* tend to move stirrup 23 in the direction of arrow f with respect to supporting plaques 17.

The stirrup plaques 23 each present four slots 25 co-operating respectively with pins 7 of the button and pin 15 driven by cylinder 10 with a view to the operation of the bolt 3, either by button 5 or by a key operating said cylinder 10.

Note that the straight line passing through the centre of the slots 25 of the stirrup 23 forms a slight angle with the longitudinal axis of the lock. Thus a self-locking bolt. In fact, when bolt 3 is in the active position, fully fitted in catch 4, it is not possible to move it by pressing on the bolt. In fact, if pressure is applied following arrow f on the bolt, the button tends to turn in the direction of arrow Y, due to the incline of the straight line joining slots 23, and the linchpin 7 of this button abuts against part 26 of one of the supporting plaques 7 prohibiting any movement of the bolt. To ensure good functioning of the lock, it is important that extensions 21, 22 are placed perpendicular to the straight line joining slots 25.

Bolt 3 can therefore only be moved backwards and forwards by button 5 or cylinder 10.

This part 1 of the lock is intended to be fixed to the door leaf partly with the help of screws not illustrated.

Catch 4 of the lock comprises a housing presenting a general U form intended to be fixed with the help of screws not illustrated, on the frame partly by its central median part 27.

Wings 28 of the housing comprise on their internal side, oblique grooves 29, i.e. forming an angle with the moving direction of bolt 3 of the lock.

A runner 30 whose two opposite edges are equipped with forms 31 corresponding to the grooves 29 slides in these grooves, under action of the adjusting screw 32.

This runner comprises an opening 33 with one side 34 constituting a supporting face for bolt 3 of the lock.

The catch comprises another blocking device of the runner in the desired position which comprises two plaques 34, 35, leaning on the back and front sides of the wings of the housing 28 joined by screws 36 passing through the runner 30.

When the srews 36 are loosened, it is possible, with the help of screw 32, to adjust in a continuous fashion and with all the desired precision, the position of the supporting face 34 for the bolt. This adjustment having been carried out, the screws 36 are tightened causing the runner to block in this position. Preferably, the wings of the housing 28, seen from the side, widen very gradually from the base of the U towards their free ends. In this way a better fixing of the plaques 34, 35 is obtained. For one variant it can be foreseen that the front and back edges of the wings of the housing 28 are rough or slotted, similarly the corresponding sides of plaques 34, 35, with a view to fixing the plaques better and therefore the runner on the housing.

It will be noticed that the forms 31 of the runner 30 are not centred on its symmetry axis so that in turning the runner, the opposite edge of opening 33 then serving as a supporting component, are obtained for identical positions of the runner 30 with respect to the housing 27, 28, different positions of the supporting component 34 for the bolt. Through this artificial means the adjusting capacity of the catch can be doubled for a given incline of the grooves.

It is possible for the grooves 29 to be inclined so that a maximum movement of the runner corresponds to a rising movement of the supporting surface corresponding to half of the thickness of the bolt.

Covers or caps 37, 38 are intended to encircle the housing 27, 28. Cap 37 is fixed by screws 39 co-operating with a threading provided in the adjusting screws 32.

I claim:

1. A keeper comprising a bolt receiving housing for said keeper, said housing being intended to be fixed to the frame of a door, characterized by the fact that said housing comprises on two internal sides facing each other parallel grooves forming an angle with the direction of movement of the bolt; said bolt having a supporting component and a runner presenting an opening allowing said bolt and said supporting component of the bolt to pass; members corresponding to the said grooves adapted to slide in said grooves; adjusting means being provided to allow the runner to move with respect to the housing and a blocking device for fixing the runner on the housing in the desired position.

2. A keeper according to claim 1, characterized by the fact that the housing has a U shape and that the grooves are made in the internal sides facing each other of the wings of the U.

3. A keeper according to claim 1 characterized by the fact that the said members co-operating with said grooves are displaced with respect to the longitudinal symmetry axis of the said runner and therefore with respect to the symmetry of one axis of its opening.

4. A keeper according to claim 1, characterized by the fact that the adjusting means of the position of the runner are set-screws.

5. A keeper according to claim 1, characterized by the fact that the blocking device comprises two plaques connected by the screws crossing said runner, said plaques bearing against the front and back sides of the housing.

6. A keeper according to claim 1, characterized by the fact that a bolt and stirrup therefor are provided and the stirrup has slots which are centered on a straight line forming an angle with the moving direction of movement of the bolt.

7. A keeper according to claim 1, having a pair of extensions, said extensions being guided in a direction forming a right angle with the straight line connecting the slots.

8. A keeper according to claim 1 characterized by the fact that the U-shape wings of the housing of the catch widen slightly starting from the base.

9. A keeper according to claim 4, said adjusting means comprising an adjusting screw, a catch and a cap screwed into said adjusting screw, a set screw being carried by said cap, said cap being screwed into a threaded opening in the adjusting screw which is provided for adjusting the position of the runner.

10. A keeper according to claim 9, having an operating linchpin for said bolt and a cylinder, said linchpin being driven by the cylinder, said linchpin being held between a ring, pivoted in an opening of the base plaque and a cover leaning on the internal face of said plaque and rivited to another plaque leaning on the other face of the base plaque.

* * * * *